US005950486A

United States Patent [19]

Owens

[11] Patent Number: 5,950,486

[45] Date of Patent: Sep. 14, 1999

[54] EXTREME CLOSE END BENDING DIE

[76] Inventor: Carl H. Owens, 5215 Phillips Hwy., Suite 1, Jacksonville, Fla. 32207

[21] Appl. No.: 09/186,008

[22] Filed: Nov. 4, 1998

[51] Int. Cl.[6] ..... B21D 7/04

[52] U.S. Cl. ..... 72/459; 72/218; 72/369

[58] Field of Search ..... 72/217, 218, 149, 72/369, 458, 459

[56] References Cited

U.S. PATENT DOCUMENTS

| | | | |
|---|---|---|---|
| 1,265,102 | 5/1918 | Morris | 72/217 |
| 1,650,955 | 11/1927 | Miller | 72/459 |
| 2,880,779 | 4/1959 | Mingori | 72/212 |
| 3,818,738 | 6/1974 | Okamuro | 72/149 |
| 4,198,840 | 4/1980 | Nielsen et al. | 72/217 |
| 4,389,873 | 6/1983 | Schwarz et al. | 72/217 |
| 4,785,650 | 11/1988 | Lusty | 72/217 |
| 5,237,847 | 8/1993 | Owens | 72/213 |

FOREIGN PATENT DOCUMENTS

| | | | |
|---|---|---|---|
| 2-290622 | 11/1990 | Japan | 72/149 |

*Primary Examiner*—David B. Jones
*Attorney, Agent, or Firm*—Thomas C. Saitta

[57] ABSTRACT

A bending die or shoe having a semi-circular tube-receiving bending channel on its forward end, the bending channel merging into a straight lateral channel, where the die is improved by providing a fitting recess or notch on the side opposing the lateral channel, such that a fitting mounted onto a tube can be positioned in the recess whereby the end of the fitting abuts and the portion of the tube immediately adjacent the fitting is received by the curved bending channel such that a bend can be imparted to the tube immediately adjacent the fitting. Preferably the bending die is also provided with a sleeve recess or channel positioned between the fitting recess and the bending channel for use with fittings which have tubular sleeves extending a short distance from the fitting.

16 Claims, 2 Drawing Sheets

EXTREME CLOSE END BENDING DIE

BACKGROUND OF THE INVENTION

This invention relates generally to the field of bending dies, also known as shoes or rams, which are used in connection with various types of bending equipment to cold bend pipes or tubes, where the bending die has a curved bending channel to receive the tube, and the tube and die together are advanced against or between fixed members or rollers to impart a bend in the tube.

Tube bending equipment for forming a curved metal tube are well known in the art. One type of such equipment consists of a bending die which has a semi-circular tube-receiving channel, where the bending die is mounted onto an actuator means or ram capable of advancing the die with sufficient force to create a bend in the tube. The tube is mounted in the bending channel and the die is advanced between a pair of lateral rollers, fixed in position, each of the rollers also having a channel to receive the tube. As the die advances between the lateral rollers, the tube is bent. A representative example of this type of bending equipment is shown in U.S. Pat. No. 2,880,779 to Mingori. The general state of the art was improved by my U.S. Pat. No. 5,237,847, in which an extended forward lip was provided on the bending shoe to prevent folding and creasing of thin-walled tubes during the bending process, and the disclosure of that patent regarding the operation of bending equipment utilizing such a bending die is incorporated herein.

A different problem encountered in the field is addressed in this instance, namely the problem associated with creating a bend in a tube having an attached fitting on its end such that the tube is bent immediately adjacent the fitting. Prior designs for bending shoes incorporate a pair of parallel lateral channels extending to the rear of the bending channel. This enables the bending shoe to advance forward enough relative to the lateral rollers to impart a full 180 degree bend in the tube. Because of the presence of these lateral channels in the bending die, a bend could not be made at the extreme close end of a tube having a fitting, such as a flared nut or the like, since with the fitting abutted against the back side of the bending die the immediately adjacent portion of the tube was received in the straight lateral channel and would remain unbent to until the point where the semi-circular bending channel began.

It is an object of this invention to provide a bending die for use in tube bending equipment where the die is structured such that a bend can be imparted into a tube having a fitting at a point immediately adjacent the fitting. This and other objects which will be apparent from the disclosure to follow are accomplished by providing a fitting recess or notch in one side of the bending die which allows the fitting to be positioned abutting the semi-circular bending channel during the bending operation.

SUMMARY OF THE INVENTION

The invention comprises in general a bending die or shoe of the type having a semi-circular or curved tube-receiving bending channel on its forward end, the bending channel merging into a straight lateral channel which is parallel to the direction of advancement of the bending die, the bending channel having two forward lips to retain a tube and the lateral channel having two lateral lips which abut with corresponding roller lips on lateral rollers as the bending die is advanced, where the die is improved by providing a fitting recess or notch on the side opposing the lateral channel, such that a fitting mounted onto a tube can be positioned in the recess whereby the end of the fitting abuts, and the portion of the tube immediately adjacent the fitting is received by, the curved bending channel such that a bend can be imparted to the tube immediately adjacent the fitting. Preferably, the bending die is of the type having extended forward lips which extend beyond the midpoint of the tube to prevent crimping or folding during the bending operation. Also preferably, the bending die is provided with a sleeve recess or channel positioned between the fitting recess and the bending channel for use with fittings which have tubular sleeves extending a short distance from the fitting.

DETAILED DESCRIPTION OF THE INVENTION

With reference to the drawings, the invention will now be described in detail with regard for the best mode and the preferred embodiment. In general the invention comprises a bending die or shoe, or an improvement to a bending die, of the type used in tube bending devices which incorporate a tube-receiving bending die forcibly advanced between two laterally mounted rollers. The bending die is advanced by suitable power means, which may be hydraulic, electric, pneumatic or the like, and has a curved, usually semi-circular, bending channel on its forwad end which receives the tube to be bent.

Figure 1:
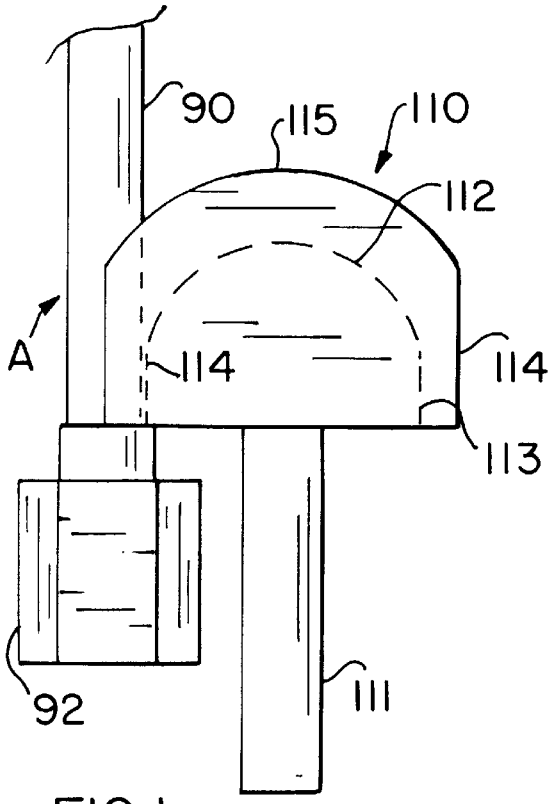
FIG. 1 PRIOR ART
FIG. 1 is a prior art illustration which shows the inability of known designs to impart a bend in a tube immediately adjacent the fitting or sleeve member.

A representative prior art bending die 110 is illustrated in FIG. 1. The bending die 110 is mounted onto a pin 111 for connection to the advancement means, and the die 110 itself comprises a forward, semi-circular, tube-receiving bending channel 112 with a pair of forward lips 115, a pair of parallel, straight, tube-receiving lateral channels 113 with lateral lips 114, the bending channel 112 merging into the lateral channels 113 on each side. A tube 90 having a fitting 92, such as a flare nut or other type connector, and a sleeve member 91 is shown positioned in the bending die 110 in a manner illustrating the closest possible bend which can be imparted to the tube 90 in the vicinity of the fitting 92 and sleeve 91. Because the bending channel 112 and lateral channels 113 must correspond tightly to the outer diameter of the tube 90, the closest point to fitting 92 and sleeve 91 at which a bend can be imparted in tube 90 is shown as point A, which as seen is some distance away from the point where tube 90 meets the end of sleeve 91. This is because of the presence of the lateral channel 114 adjacent the sleeve 91.

Figure 2:
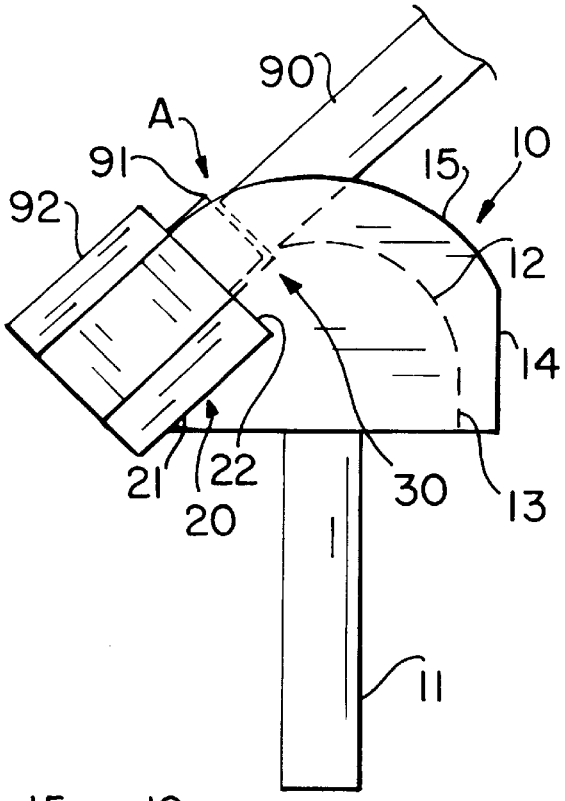
FIG. 2 is a view of the invention with a tube having a fitting and sleeve positioned within the fitting recess and the sleeve recess such that a close-end bend can be imparted to the tube.
Figure 5:
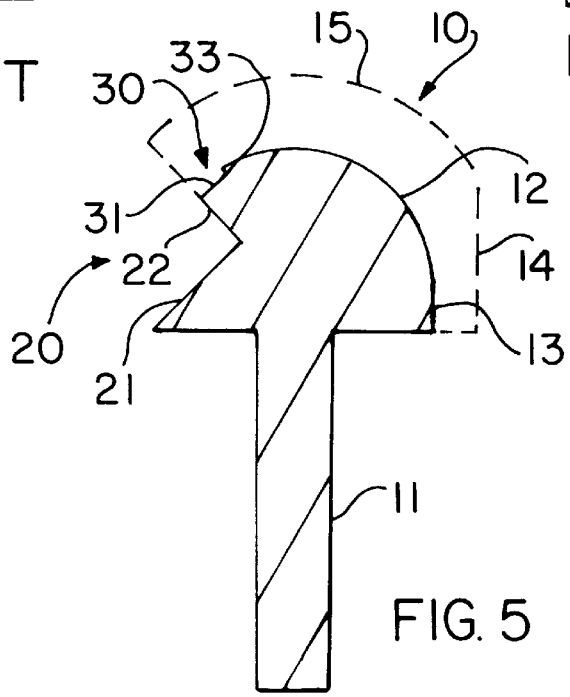
FIG. 5 is a cross-sectional view of the bending die taken along line V—V of FIG. 4.
Figure 3:
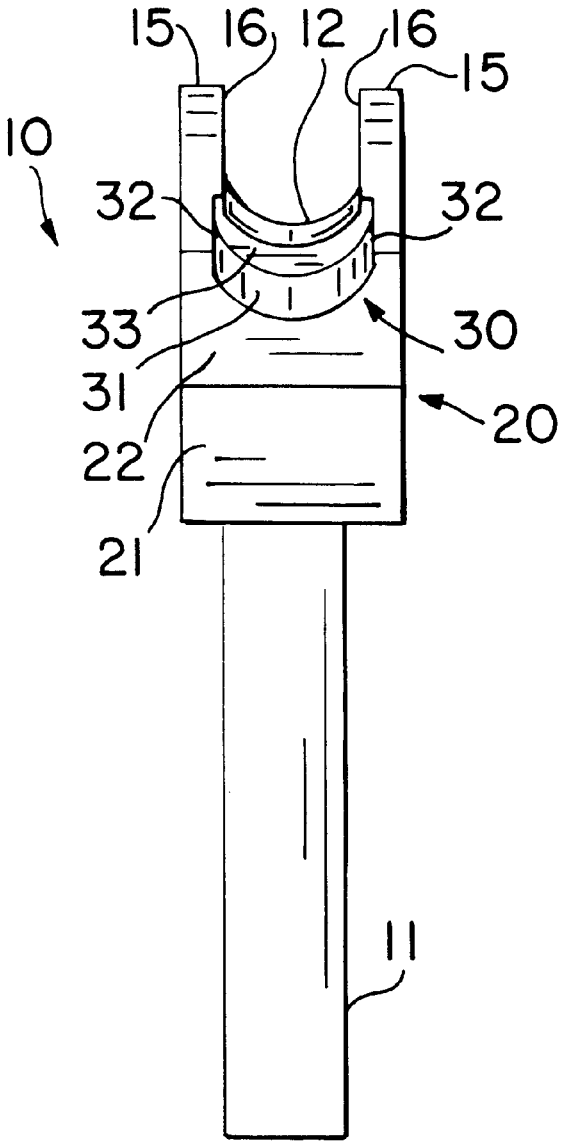
FIG. 3 is a lateral view of the bending die showing the fitting recess and the sleeve recess.
Figure 4:
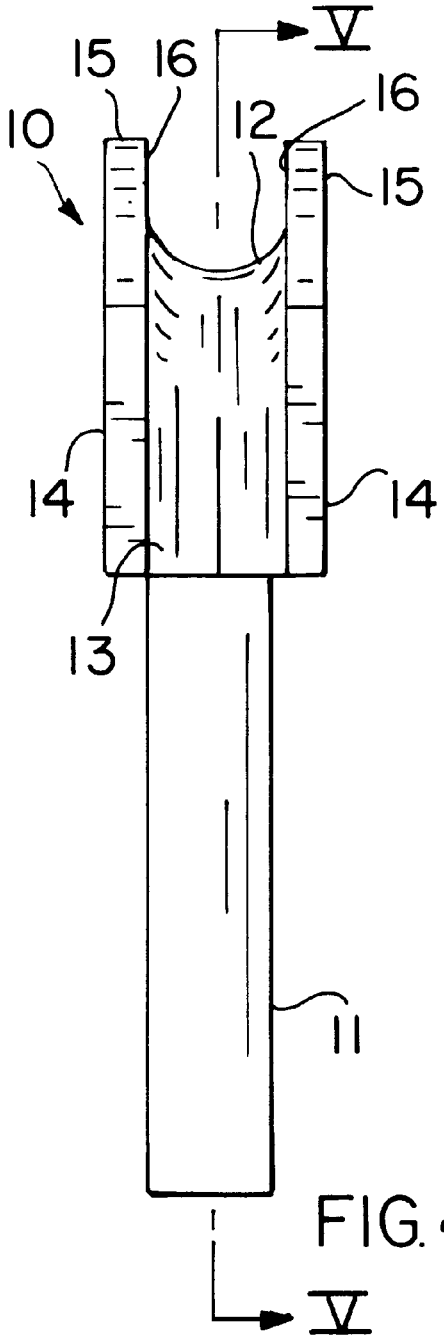
FIG. 4 is a lateral view of the opposite side of the bending die from FIG. 3, showing the bending channel and the lateral channel.

The invention is illustrated in FIGS. 2 through 5, and is a tube bending die 10 for use with tube bending equipment as described. Bending die 10 comprises a mounting pin 11 for attachment of the die 10 to the powered advancement means of the tube bending equipment, a semi-circular, tube-receiving, forward channel 12 between two forward lips 15, a straight, tube-receiving, lateral channel 13 between two lateral lips 14, a fitting recess 20 and preferably as shown a sleeve recess 30. The bending channel 12 merges into the lateral channel 13, with the lateral channel 13 being parallel to the advancement direction of the die 10 during the bending operation. The fitting recess or notch 20 is located laterally on the bending die 10 generally opposite from the lateral channel 13. Preferably as shown, the forward lips 15 are extended beyond the semi-circular portion of the bending channel 12 such that two parallel channel walls 16 are formed, as best seen in FIGS. 3 and 4, such that the channel walls 16 will extend beyond the midpoint of a tube 90 being bent to prevent folding or crimping of the tube 90. The forward lips 15 are semi-circular to match the curvature of the bending channel 12, while the lateral lips 14 are truncated and straight-edged in order to correspond with the lateral channel 13 as well as to properly meet the lips on the fixed lateral rollers of the tube bending equipment.

Fitting recess 20 comprises a side wall 21 and a face wall 22, both preferably planar and set perpendicular to each other, with the face wall 22 perpendicular to a line tangent to the end of the bending channel 12. The face wall 22 is preferably set at 45 degrees to the line parallel to the advancement direction taken through the midpoint of the semi-circular bending channel 12, although other angles are possible so long as the face wall 22 of the fitting recess 20 is not perpendicular to the advancement direction. The fitting recess 20 is sized sufficient to receive fittings 92 of a size normally associated with the diameter of the tube 90 being bent, such that relatively speaking the dimensions of a fitting recess 20 will be larger for a bending die 10 having a large diameter bending channel 12, while the dimensions of a fitting recess 20 for a bending die having a smaller diameter bending channel 12 will be smaller. Where no sleeve recess 30 is present, the face wall 22 and bending channel 12 will meet, with no straight, lateral channel existing on that side of the bending die 10.

Preferably, the bending die 10 is also provided with a sleeve recess 30 for receiving the short, thin-walled, tubular sleeve member 91 which is used in connecting many fittings 92 to tubes 90. The sleeve recess 30 is a generally cylindrical channel having a semi-circular section 31 slightly larger in diameter than the bending channel 12 with generally planar lateral sections 32 cut out of each of the channel walls 16 such that the sleeve 91 can be slipped into the sleeve recess 30. The forward part of the sleeve recess 30 is defined by an abutment shoulder 33 which transitions into the bending channel 12.

As seen in FIG. 2, the design of the bending die 10 allows the attached fitting 92 and sleeve 91 of tube 90 to be positioned within fitting recess 20 and sleeve recess 30 such that the junction of the sleeve 91 and the tube 90 is placed at the curved bending channel 12, such that the bending point A occurs where the tube 90 immediately exits the sleeve 91. In this manner a tube 90 can be bent immediately adjacent the end of the sleeve 91, or immediately adjacent the fitting 92 if no sleeve is present as a component of the fitting 92.

It is understood that equivalents and substitutions to elements and components set forth above may be obvious to those skilled in the art, and therefore the true scope and definition of the invention is to be as set forth in the following claims.

I claim:

1. A bending die comprising a forward curved bending channel having an end for receiving a metal tube to be bent, a fitting recess abutting said bending channel for receiving a fitting connected to the metal tube, and a sleeve recess positioned between said fitting recess and said bending channel for receiving a sleeve member connected to said metal tube, whereby the tube is bent immediately adjacent the sleeve member.

2. The die of claim 1, where said sleeve recess comprises a semi-circular section, a pair of lateral sections extending from said semi-circular section and an abutment shoulder between said semi-circular section and said bending channel.

3. The die of claim 2, where said fitting recess comprises a side wall and a face wall, said side wall adjoining said face wall, said face wall being perpendicular to a line tangent to the end of said bending channel.

4. The die of claim 3, where said bending channel has a midpoint and a forward advancement direction, where said face wall is at an angle of 45 degrees to a line parallel to said forward advancement direction and passing through said midpoint.

5. The die of claim 3, where said bending channel has a midpoint and a forward advancement direction, where said face wall is at a non-perpendicular angle to a line parallel to said forward advancement direction and passing through said midpoint.

6. The die of claim 1, where said fitting recess comprises a side wall and a face wall, said side wall adjoining said face wall, said face wall being perpendicular to a line tangent to the end of said bending channel.

7. The die of claim 6, where said bending channel has a midpoint and a forward advancement direction, where said face wall is at an angle of 45 degrees to a line parallel to said forward advancement direction and passing through said midpoint.

8. The die of claim 6, where said bending channel has a midpoint and a forward advancement direction, where said face wall is at a non-perpendicular angle to a line parallel to said forward advancement direction and passing through said midpoint.

9. A bending die for bending a metal tube having an attached fitting, said bending die comprising a mounting pin for connection to a piece of tube bending equipment, a semi-circular, tube-receiving, bending channel, two forward lips and two lateral lips, said bending channel positioned between said two forward lips, a straight, tube-receiving, lateral channel between said two lateral lips and connected to said bending channel, and a fitting recess positioned opposite to said lateral channel and abutting said bending channel, whereby said fitting recess receives the fitting whereby the metal tube contacts said bending channel such that the metal tube may be bent at a point immediately adjacent the fitting, and further comprising a sleeve recess sized to receive a sleeve member connecting the fitting to the tube, said sleeve recess positioned between said fitting recess and said bending channel.

10. The die of claim 9, where said fitting recess comprises a side wall and a face wall, said side wall adjoined to said face wall, said face wall abutting said bending channel.

11. The die of claim 10, where said face wall is perpendicular to said side wall.

12. The die of claim 11, where said bending die has a forward advancement direction and said face wall is at a 45 degree angle to a line parallel with said advancement direction.

13. The die of claim 11, where said bending die has a forward advancement direction and said face wall is at a non-perpendicular angle to a line parallel with said advancement direction.

14. The die of claim 9, where said sleeve recess comprises a semi-circular section, a pair of lateral sections connected to said semi-circular section, and an abutment shoulder between said semi-circular section and said bending channel.

15. A bending die comprising a forward curved bending channel having an end for receiving a metal tube to be bent and a linear forward advancement direction, and a fitting recess abutting said bending channel for receiving a fitting connected to the metal tube, said fitting recess comprising a side wall and a face wall, said side wall adjoining said face wall, said face wall being perpendicular to a line tangent to the end of said bending channel, whereby the tube is bent immediately adjacent the fitting by advancing said die along said forward advancement direction, where said face wall is at a non-perpendicular angle to a line parallel with said linear forward advancement direction.

16. The die of claim 15, where said face wall is at an angle of 45 degrees to said line parallel with said linear forward advancement direction.

* * * * *